US012253261B2

(12) United States Patent
Wang et al.

(10) Patent No.: US 12,253,261 B2
(45) Date of Patent: Mar. 18, 2025

(54) LOW-CONCENTRATION GAS DIFFERENTIAL COMBUSTION DEVICE

(71) Applicant: BEIJING JUNFA COMBUSTIBLE GAS TECHNOLOGY DEVELOPMENT CO., LTD, Beijing (CN)

(72) Inventors: Xiaomin Wang, Beijing (CN); Junting Yang, Beijing (CN)

(73) Assignee: BEIJING JUNFA COMBUSTIBLE GAS TECHNOLOGY DEVELOPMENT CO., LTD., Beijing (CN)

( * ) Notice: Subject to any disclaimer, the term of this patent is extended or adjusted under 35 U.S.C. 154(b) by 612 days.

(21) Appl. No.: 17/626,924

(22) PCT Filed: Oct. 17, 2019

(86) PCT No.: PCT/CN2019/111555
§ 371 (c)(1),
(2) Date: Jan. 13, 2022

(87) PCT Pub. No.: WO2021/012417
PCT Pub. Date: Jan. 28, 2021

(65) Prior Publication Data

US 2022/0260251 A1 Aug. 18, 2022

(30) Foreign Application Priority Data

Jul. 23, 2019 (CN) ..... 201910665478.9

(51) Int. Cl.
*F23D 14/82* (2006.01)
*C10L 3/10* (2006.01)
(Continued)

(52) U.S. Cl.
CPC ..... *F23D 14/82* (2013.01); *C10L 3/106* (2013.01); *F23D 14/46* (2013.01); *F23D 14/68* (2013.01);
(Continued)

(58) Field of Classification Search
CPC ..... F23D 14/46; F23D 14/68; F23D 14/82; F23D 2209/10; F23D 2207/00; F23D 2900/0014; C10L 3/106; C10L 2290/08
(Continued)

(56) References Cited

U.S. PATENT DOCUMENTS 10,429,066 B2 * 10/2019 Schröter ..... F23G 7/066

FOREIGN PATENT DOCUMENTS

CN 2835924 Y 11/2006
CN 102562131 A 7/2012
(Continued)

OTHER PUBLICATIONS

International Search Report (including English translation) and Written Opinion for International Application No. PCT/CN2019/111555, dated Apr. 9, 2020, 9 pages.

*Primary Examiner* — Steven B McAllister
*Assistant Examiner* — John E Bargero
(74) *Attorney, Agent, or Firm* — Westman, Champlin & Koehler, P.A.

(57) ABSTRACT

A low-concentration gas differential combustion device includes a low-concentration gas super-cooling dehydration and demisting device, a gas pretreatment device, a burner, a long-term burning open fire device, a high-energy self-heat dispersion rapid ignition device, a combustion chamber, and a waste-heat utilization device. With the low-concentration gas differential combustion device, the problems of gas escaping, forced direct emission, low heat extraction efficiency, concentration over-limit explosions, increase in
(Continued)

equipment volume and increase in investment caused by the reversal process in the existing ventilation air oxidation technology, and the problems of narrow gas adaptation concentration range, small adaptive concentration and pressure change amplitude, poor combustion temperature adjustability, high NOx content, high shutdown rate, and low gas utilization rate in the low-concentration gas internal combustion engine power generation technology are solved.

8 Claims, 6 Drawing Sheets

(51) Int. Cl.
*F23D 14/46* (2006.01)
*F23D 14/68* (2006.01)

(52) U.S. Cl.
CPC ..... *C10L 2290/08* (2013.01); *F23D 2209/10* (2013.01)

(58) Field of Classification Search
USPC ..... 431/5
See application file for complete search history.

(56) References Cited

FOREIGN PATENT DOCUMENTS

| | | | |
|---|---|---|---|
| CN | 102767836 | A | 11/2012 |
| CN | 104566367 | A | 4/2015 |
| CN | 104990092 | A | 10/2015 |
| JP | 3632904 | B2 | 3/2005 |

* cited by examiner

LOW-CONCENTRATION GAS DIFFERENTIAL COMBUSTION DEVICE

CROSS REFERENCE TO RELATED APPLICATIONS

The application is a 371 National Stage Application of International Application No. PCT/CN2019/111555, filed on Oct. 17, 2019, entitled "LOW-CONCENTRATION GAS DIFFERENTIAL COMBUSTION DEVICE", which published as WO 2021/012417 A1 on Jan. 28, 2021, which claims priority to Chinese patent application No. 201910665478.9, filed on Jul. 23, 2019, the disclosures of which are incorporated herein by reference in their entireties.

TECHNICAL FIELD

The present disclosure relates to a low-concentration gas differential combustion device, in particular, the present disclosure relates to the technical field of low-concentration gas recovery and utilization.

BACKGROUND

In the modern coal-mining industry production process, gas with a concentration of 30% or higher is called high-concentration gas, most of which is used directly, and gas with a concentrations of 3-30% is called low-concentration gas, which is difficult to use directly. After the domestic low-concentration gas power generation technology is mature, most of the gas with a concentration of 9-30% is used for power generation with an internal combustion engine gas power generation technology. The low-concentration gas of 6-9% can be ignited by diesel for power generation (This needs to be demonstrated by economics, and there are basically no application cases). For windblown mine gas no higher than 0.75% (usually the concentration of coal mine ventilation air methane is controlled at no higher than 0.2%), and the technology of countercurrent regenerative thermal oxidation of ventilation air is currently used. However, it is difficult to maintain its own high-temperature environment and continuous operation only by performing countercurrent oxidation on the ventilation air, and even a large amount of fuel is required to maintain the operation. In the industry, the low-concentration gas of 3-8% is usually diluted into the windblown mine gas and directly discharged into the atmosphere through the drainage pumping station. Only a very small part is blended into higher-concentration gas for low-concentration gas power generation and blended into the ventilation air to increase the inlet concentration into the oxidation device, and the mixed concentration is controlled at 1.2% or less for utilization. There is still a large amount of low-concentration gas emissions, resulting in a large amount of waste of energy and a greenhouse gas effect equivalent to 21 times the same quality of $CO_2$.

At present, the windblown mine gas is called ventilation air. Since the inlet gas concentration is restricted to 1.2% or less, the volumetric flow rate of gas involved in oxidation and heat storage and the volume of the device are very large, and the heat extraction efficiency is only about 60%. The economic benefits of heat extraction are very small. If there is no CDM trading market and national financial subsidies, it is far from possible to recover the investment of the project by simply relying on the heat extraction benefits of the ventilation air oxidation.

Specifically, in addition to the extremely low concentration of methane gas in the discharged ventilation air, since it is a gas diluted with air and has a large flow rate, it will not only cause environmental pollution but also waste a lot of energy. In response to the country's call for energy conservation, consumption reduction, and environmental pollution reduction, in the prior art, many companies can only oxidize and recycle a small amount of gas in the ventilation air by using traditional ventilation air countercurrent regenerative oxidation devices and other equipment, in order to facilitate the environmental protection, energy saving and emission reduction requirements currently advocated.

However, when the countercurrent is reversed, a large amount of ventilation air methane will escape. At the same time, due to the single structure of heat extraction of the domestic products, the final exhaust smoke temperature rises and a large amount of exhaust smoke heat loss is formed, which ultimately causes the thermal efficiency of the entire process to be low, resulting in poor economic efficiency. The investment and construction of the ventilation air oxidation project are restricted.

On the other hand, after technologies of low-concentration gas power generation unit and system are mature, the low-concentration gas of 9-30% is widely used in gas internal combustion engine power generation. In terms of the efficiency of low-concentration gas entering the internal combustion engine for power generation alone, its power generation efficiency is the highest. The domestic low-concentration gas generation unit can reach a power generation efficiency of 36% or more when the concentration, gas amount and pressure are stable. However, the low-concentration gas extracted in coal mine production is affected by changes in the underground extraction area, replacement (removal and connection) of the pipeline, water drainage and other operations, resulting in great and frequent fluctuations in the concentration, flow rate and pressure of the low-concentration gas. The low-concentration gas power generation unit has strict requirements for the adaptability of gas changes. It requires that the gas concentration change rate does not exceed 1%/min, and the gas source pressure change rate of the low-concentration gas power generation system does not exceed 1 KPa/min. Once the concentration change rate or the pressure change rate of the gas exceeds the required rate, it is easy to cause the low-concentration gas power generation unit to have reverse power, over-high cylinder temperature protection shutdown and separation. Especially when the concentration is lower than 8%, the unit basically cannot perform continuous power generation, and the system often causes a large amount of low-concentration gas to be directly discharged due to gas fluctuations. Especially for low-concentration gas power generation companies that generate electricity on the grid, they often need to apply for grid connection to the Electricity Power Bureau after each unit is shut down and cannot be approved in time, which will cause a large amount of low-concentration gas to be discharged for a long time and cannot be used. Direct emission of low-concentration gas will cause a lot of energy waste and atmospheric environmental pollution. In addition, from the analysis of the working conditions of gas combustion in the internal combustion engine, the combustion temperature is not adjustable, and the combustion temperature is usually much higher than 1200° C., which causes the $NO_x$ content in the exhaust smoke of the gas power generation unit to seriously exceed the standard. The $NO_x$ content in the exhaust smoke of the domestic low-concentration gas power generation unit is usually greater than 1800 PPm. If no out-of-stock measures are taken, it will seriously pollute the environment.

From the perspective of the overall utilization rate of the low-concentration gas, although the low-concentration gas power generation unit has a relatively high power generation efficiency, the overall efficiency of the low-concentration gas power generation unit system is often reduced due to gas source fluctuations (the coal mine safe regulations require that low-concentration gas cannot be stored and buffered in any form), incomplete combustion in the unit, cylinder temperature protection shutdown, difficulty in applying for multiple grid connections, and failure of individual spark plugs of the unit itself, etc.

For low-concentration gas with a concentration of 3-8%, the low-concentration gas power generation unit cannot be used directly. Some companies have developed diesel ignition technology to burn low-concentration gas of 6-8%, which adds diesel fuel to the unit to make the unit work and generate electricity. However, if a simple gas source concentration of a coal mine is 6-8%, the gas fluctuations will also often occur, and the diesel ignition technology is also difficult to adapt to the changes in the gas source, so that this technology is not well applied and popularized.

Based on the above analysis, the current utilization mode of low-concentration gas of 3-8% is indirect utilization. In the first mode, the low-concentration gas is blended into the ventilation air and then enters the countercurrent regenerative ventilation air oxidation device after being diluted, and the concentration of the blended ventilation air methane at the inlet of the ventilation air oxidation device is strictly controlled at ≤1.2%. In the second mode, when the concentration of the relatively high part of the low-concentration gas in the coal mine is significantly higher than 9%, part of the low-concentration gas with a concentration of 3-8% is blended into it, and the concentration after blending is controlled to reach 9% or more, so that the low-concentration gas power generation unit can work normally to generate electricity.

The first indirect utilization mode of blending into the ventilation air for dilution involves the above-mentioned problems of gas escaping and low heat extraction efficiency. The second mode of partial blending into the higher concentration gas (increasing the concentration after mixing) involves the concentration requirements after blending and the restriction on the amount of low-concentration gas with a higher concentration, which often results in incomplete blending and causes the low-concentration gas source after blending to be more unstable. Consequently, operating efficiency of the unit and the overall utilization rate of gas are greatly reduced.

SUMMARY

In order to solve the above shortcomings of the prior art, the present disclosure proposes a low-concentration gas differential combustion device, which solves the problems of gas escaping, forced direct emission, incomplete combustion, low heat extraction efficiency, concentration overlimit explosion, increase in equipment volume and increase in investment in the existing low-concentration gas indirect utilization technology. At the same time, the problems of difficulty in ignition, unstable combustion, easy backfire, easy flameout and easy explosion in the existing gas facilities using gas are solved.

In order to achieve the above objectives, the specific technical solutions are as follows: A low-concentration gas differential combustion device includes: a low-concentration gas super-cooling dehydration and demisting device, a gas pretreatment device, a burner, a long-term burning open fire device, a high-energy self-heat dispersion rapid ignition device, a combustion chamber, and a waste-heat utilization device, the low-concentration gas super-cooling dehydration and demisting device is installed after a last-stage water-sealing fire-barriering explosion-venting device of a low-concentration gas safe transport system, the low-concentration gas super-cooling dehydration and demisting device is connected to a flameout and backfire protection control device and a low-concentration gas concentration regulation device, the low-concentration gas concentration regulation device is connected to the gas pretreatment device, the gas pretreatment device is connected to the burner, the burner is connected to the combustion chamber, the combustion chamber is connected to the waste-heat utilization device, and both the long-term burning open fire device and the high-energy self-heat dispersion rapid ignition device are connected to the combustion chamber.

Preferably, the low-concentration gas super-cooling dehydration and demisting device includes a demisting and cold energy recovering device, and a super-cooling and gravity dehydration device, a heat exchange tube in the demisting and cold energy recovering device is a first capillary spiral heat exchange tube, dehydrated gas flows in the first capillary spiral heat exchange tube, and the undehydrated gas flows outside the first capillary spiral heat exchange tube; the gas outside the first capillary spiral heat exchange tube enters the device from a top portion and flows out from a bottom portion to complete cold energy recovery and partial gas-water separation, a gas-water separation chamber and a wire mesh defoaming device are further provided in the demisting and cold energy recovering device to further dehydrate the supercooled gas; a heat exchange tube in the super-cooling and gravity dehydration device is a serpentine tube composed of bimetallic finned tube, an intermediate medium flows in the serpentine finned tube, and the gas flows outside the serpentine finned tube; a guide plate and a gravity dehydration chamber are further provided in the super-cooling and gravity dehydration device.

Preferably, the gas pretreatment device includes a gas inlet, a second capillary spiral heat exchange tube, a movable valve, a spiral duct, an intermediate medium inlet, and an intermediate medium outlet, the gas inlet is connected to the low-concentration gas concentration regulation device and installed behind the low-concentration gas concentration regulation device; the gas flows in the second capillary spiral heat exchange tube of the pretreatment device, enters the movable valve from an outlet at the other end of the second capillary spiral heat exchange tube, the gas opens the movable valve with its own pressure and enters the burner from an outlet of the spiral duct to which an outlet of the movable valve is connected; the intermediate medium inlet and the intermediate medium outlet are respectively connected to a low-temperature flue gas heat extraction device of the waste-heat utilization device, and an intermediate medium circulates between the low-temperature flue gas heat extraction device and the gas pretreatment device;

the spiral duct and the movable valve are arranged one-to-one, and the two are seamlessly connected, the outlet of each movable valve is connected to one spiral duct, an outlet of the entire gas pretreatment device is in a tube bundle structure, ventilation air and recirculating flue gas may be added to an outer side of the spiral duct; an outlet of the second capillary spiral heat exchange tube is connected to an internal movable valve, and the movable valve is automatically opened by the pressure of the gas, and automatically closed when the pressure is low to prevent an occurrence of a backfire phenomenon when the gas amount is too small or the pressure is too low.

Further, the burner is in direct communication with the pretreatment device, the burner is provided with an input pipeline through which a combustion-supporting medium and a compulsory cooling medium are introduced, a main body is installed on a cylindrical body of the combustion chamber, and an outlet thereof is in direct communication with the combustion chamber; the burner includes a main burner and an auxiliary burner, the main burner includes a high-temperature resistant outer casing, a ventilation air and recirculating flue gas inlet, a multilayer large-aperture galling wire mesh, and a swirler, the spiral duct extends into the burner, the multilayer large-aperture galling wire mesh abuts against the swirler, the gas enters the swirler from a wire mesh layer of the multilayer large-aperture galling wire mesh, and the gas enters the combustion chamber in a rotating manner; a gas flow velocity in the burner is lower than a flow velocity in the spiral duct, and a backfire is allowed inside the burner, since the burner is relatively short, there will be no rapid increase in combustion pressure and instantaneous blasting when a backfire occurs inside, and there will be no loud noise due to instantaneous blasting; the multilayer large-aperture galling wire mesh is used for secondary distribution and rapid ignition of ejected gas;

the auxiliary burner does not control the concentration, but directly uses low-concentration gas for buried type combustion, an outlet thereof is buried under the long-term burning open fire device, the main burner is above the auxiliary burner, the gas is ejected from the auxiliary burner and then enters a buried layer, flame penetrates through gaps of the buried layer, the buried layer utilizes different porosities to dominate a flame direction, and guides the flame of the auxiliary burner to the outlet of the main burner, the auxiliary burner allows mixed liquefied gas to remain ignited when the low-concentration gas is particularly low; a flame of long-term burning open fire of the buried layer burned by the auxiliary burner is used for long-term heating and raising a temperature of the combustion chamber, a structure of the main burner is the same as a structure of the auxiliary burner, the ventilation air and recirculating flue gas inlet of the auxiliary burner is only connected to the ventilation air, the ventilation air and recirculating flue gas inlet of the main burner may also be connected to the recirculating flue gas to control the stability of the overall temperature of the combustion chamber when the gas concentration is relatively high.

Further, the long-term burning open fire device includes a high-temperature resistant framework, porous ceramic refractory balls, and a refractory ball retaining wall, the high-temperature resistant framework supports the porous ceramic refractory balls at the outlet of the auxiliary burner, so that the outlet of the auxiliary burner retains an ejection space, the refractory ball retaining wall for the porous ceramic refractory balls is arranged directly in front of the outlet of the auxiliary burner, a gap for filling refractory balls is reserved between the refractory ball retaining wall and the high-temperature resistant framework, which is used to fill the porous ceramic refractory balls, and a guiding direction of the flame is determined by a stacking position of the porous ceramic refractory balls of different sizes; the porous ceramic refractory balls are located in the buried layer of buried type combustion, and the flame is ejected from gaps of the porous ceramic refractory balls; the flame of the long-term burning open fire and high-temperature flue gas produced by the long-term burning open fire device flow through the outlet of the auxiliary burner to the outlet of the main burner to actively ignite the outlet gas of the main burner; the long-term burning open fire device has a relatively high heat storage capacity, and even when the gas source of the auxiliary burner is cut off in a short period of time, the long-term burning open fire device still has a strong ignition capacity;

the long-term burning open fire device uses low-concentration gas with a relatively high concentration and an auxiliary burner with a relatively small diameter to maintain a long-term burning open fire state in a furnace; the long-term burning open fire device has a local ultra-high temperature structure, and the flame form thereof is a multi-beam flame form, a center of the fire source is a very small semi-sealed confined space with a deceleration effect, the confined space is formed by burying and stacking porous ceramic refractory balls with certain air permeabilities and refractory bricks with specific shapes, a local flame temperature is allowed to exceed 1600° C. for a long period of time. The air permeabilities are different, and the different air permeabilities in a transverse direction and a longitudinal direction are used to guide the direction of the long-term burning open fire, so that the flame of the long-term burning open fire and high-temperature products flow toward the outlet of the main burner outlet.

Further, the high-energy self-heat dispersion rapid ignition device includes a non-streamline long-term burning open fire solid, a non-streamline flow guide device, a bamboo basket type non-streamline dispersion reverse heating device, and a continuous high-temperature hot pool installed in the vicinity of the burner;

the non-streamline long-term burning open fire solid is a non-streamline high-temperature solid heat storage material heated after the low-concentration gas combustion, has a surface presenting an uneven shape and a porous structure, during normal operation, uses heat of the low-concentration gas combustion to raise its own temperature to 900-1100° C., and has a high-temperature ignition function;

the non-streamline flow guide device is made of refractory material having a conical contour with an uneven surface and a partially non-streamlined spiral structure, and is installed facing the main burner, the low-concentration gas ejected from the main burner is first guided and dispersed by the non-streamline flow guide device;

the bamboo basket type non-streamline dispersion reverse heating device has a porous structure, which allows a small amount of gas to be heated and pass through gaps, and at the same time reversely guides a flow of most of the low-concentration gas and the high-temperature flue gas formed after complete combustion, and quickly mixes and ignites the reversely guided flow of the high-temperature flue gas and the newly entered low-concentration gas;

the continuous high-temperature hot pool is a high-temperature hot pool formed by a porous refractory material combined with a reverse air flow space, and constitutes reliable conditions for comprehensive heating, reverse ignition and stable combustion, at the same time, a high-temperature heat storage body composed of porous refractory materials is integrally assembled with the non-streamline flow guide device and the non-streamline long-term burning open fire solid to form a complete combination.

Preferably, the combustion chamber provides installation space for the high-energy self-heat dispersion rapid ignition device and temporarily stores the heat and high-temperature flue gas generated by combustion inside, and guides the high-temperature flue gas to flow to the outlet to provide heat for the subsequent waste-heat utilization device, the combustion chamber provides a high-temperature closed environment for combustion, so that the ignited low-concentration gas is fully reacted here.

Preferably, the waste-heat utilization device includes a low-temperature flue gas heat extraction device, and the low-temperature flue gas heat extraction device includes a case, a heat exchange element, an intermediate medium interface, a condensation port, and a low-temperature flue gas interface, the case is an outer casing of the low-temperature flue gas heat extraction device, and is provided with a heat exchange element inside, the heat exchange element is connected to the intermediate medium header, and the heat exchange element collects outflow and inflow through the intermediate medium header, the intermediate medium interface is installed on the intermediate medium header, the condensation port is installed at a bottom portion of the outer casing near an outlet for low-temperature flue gas to discharge condensed water of the low-temperature flue gas, and the low-temperature flue gas interface includes an inlet and an outlet for low-temperature flue gas.

The present disclosure solves the problems of gas escaping, forced direct emission and incomplete combustion, and problems of low heat extraction efficiency, concentration over-limit explosions, increase in equipment volume and increase in investment caused by the reversal process during the countercurrent regenerative oxidation in the existing low-concentration gas indirect utilization technology. At the same time, it solves the problems of unstable combustion, and problems of easy backfire, easy flameout and easy explosion of combustion gas in the existing gas facilities.

Figure 1:
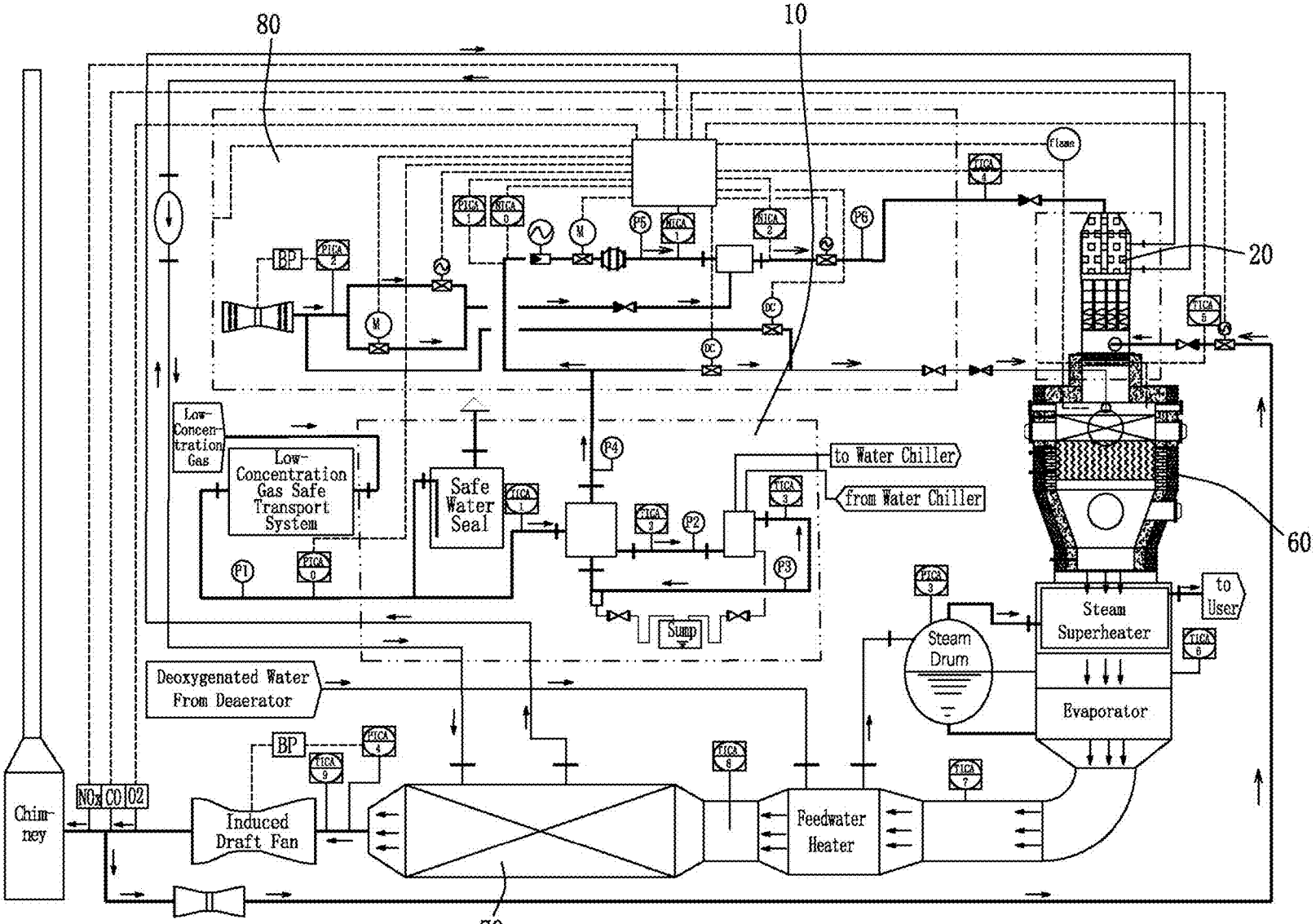
FIG. 1 is a process flow diagram of a low-concentration gas differential combustion device of the present disclosure.
Figure 2:
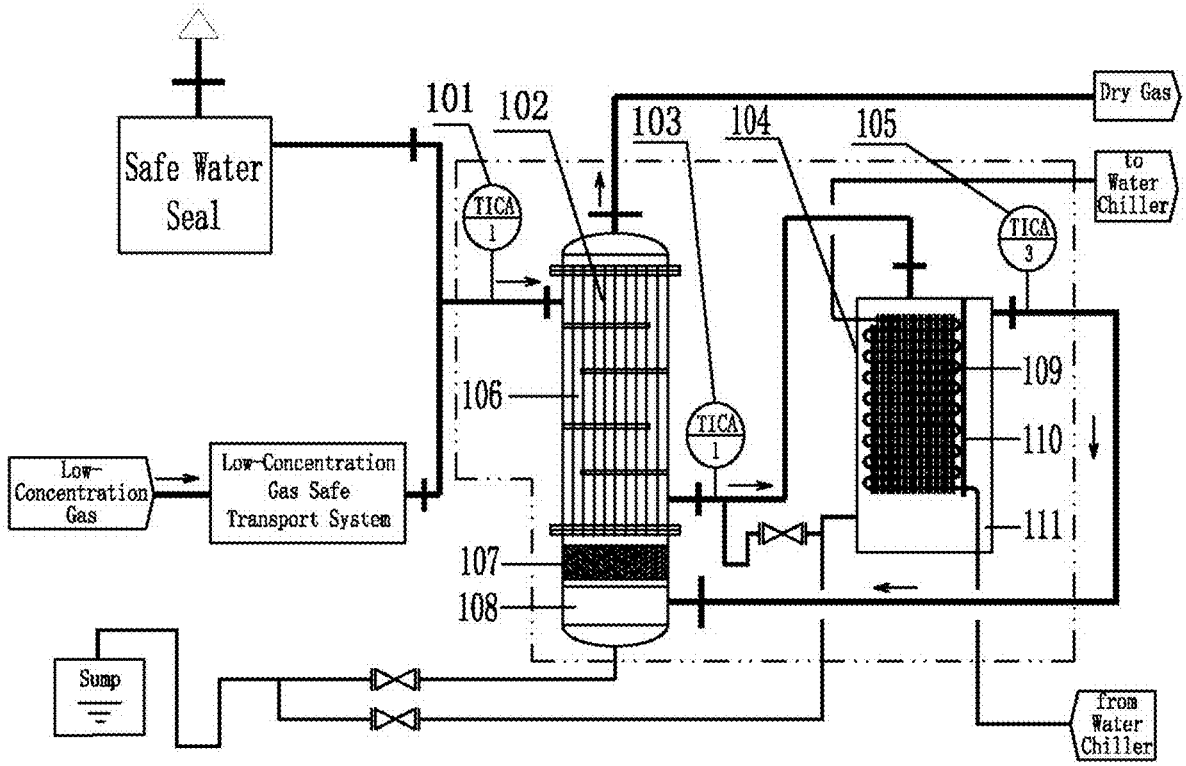
FIG. 2 is a schematic diagram of the connection structure of a low-concentration gas super-cooling dehydration and demisting device of the present disclosure.
Figure 3:
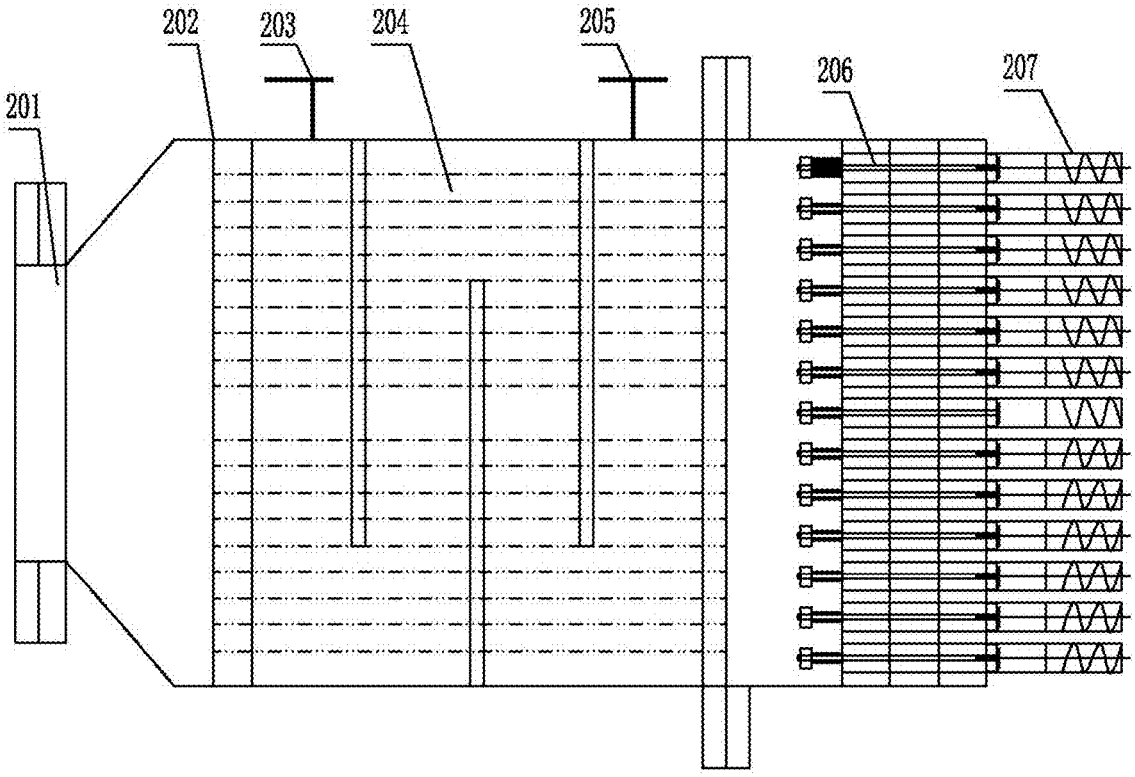
FIG. 3 is a schematic diagram of a structure of a gas pretreatment device of the present disclosure.
Figure 4:
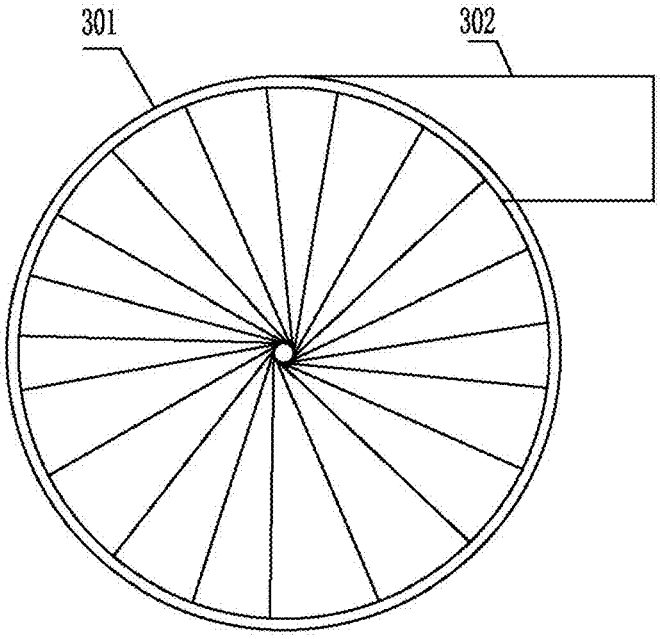
FIG. 4 is a schematic diagram of the structure of a burner of the present disclosure.
Figure 5:
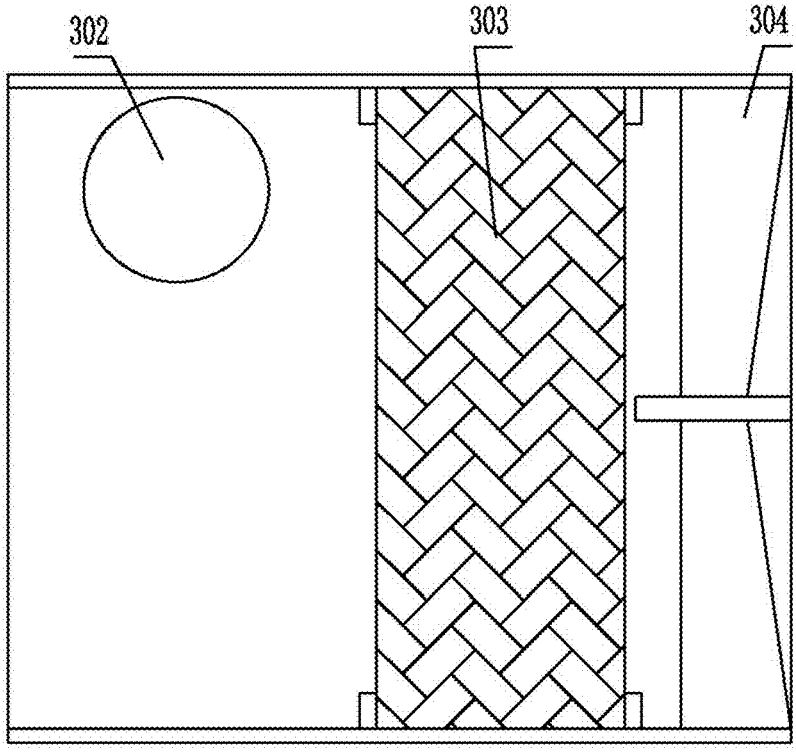
FIG. 5 is a schematic diagram of the internal structure of the burner of the present disclosure.
Figure 6:
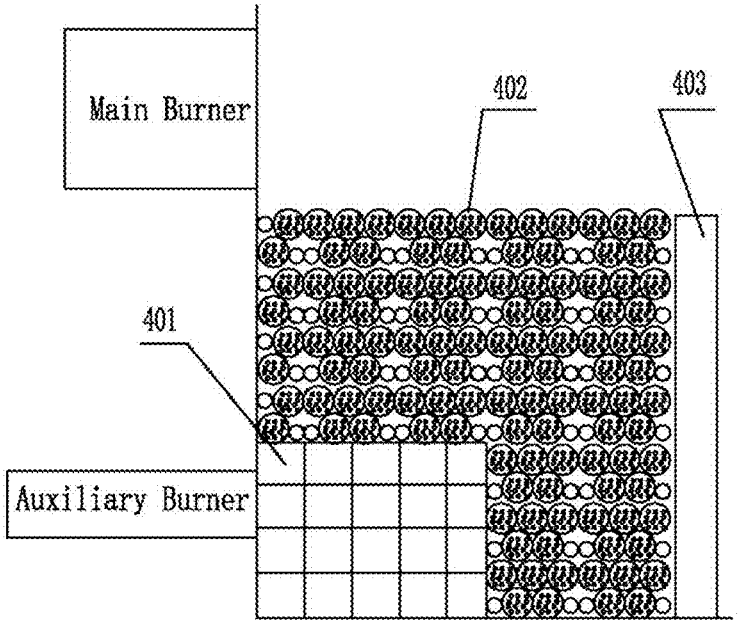
FIG. 6 is a schematic diagram of the structure of a long-term burning open fire device of the present disclosure.
Figure 7:
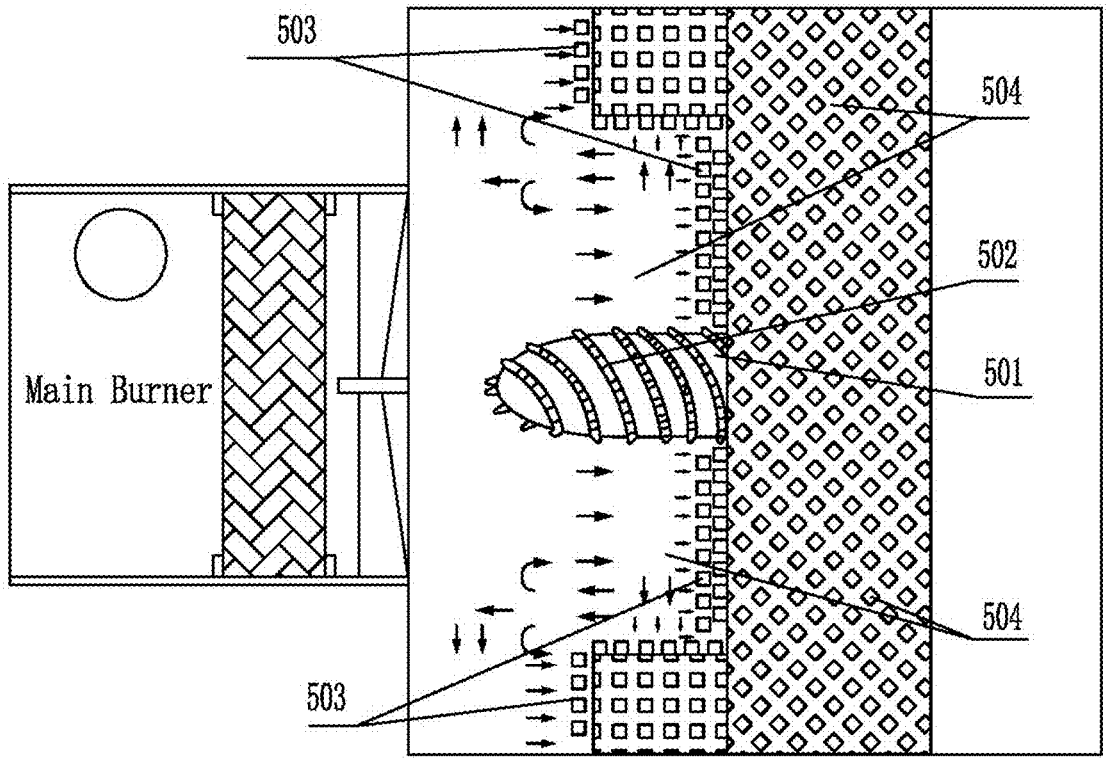
FIG. 7 is a schematic diagram of the structure of a high-energy self-heat dispersion rapid ignition device of the present disclosure.
Figure 8:
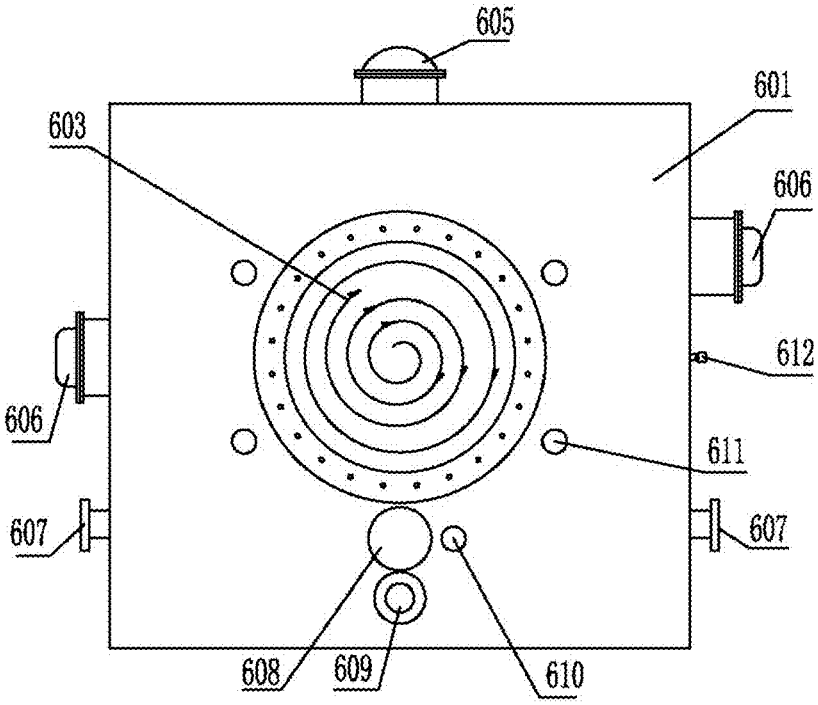
FIG. 8 is a schematic diagram of the structure of a combustion chamber of the present disclosure.
Figure 9:
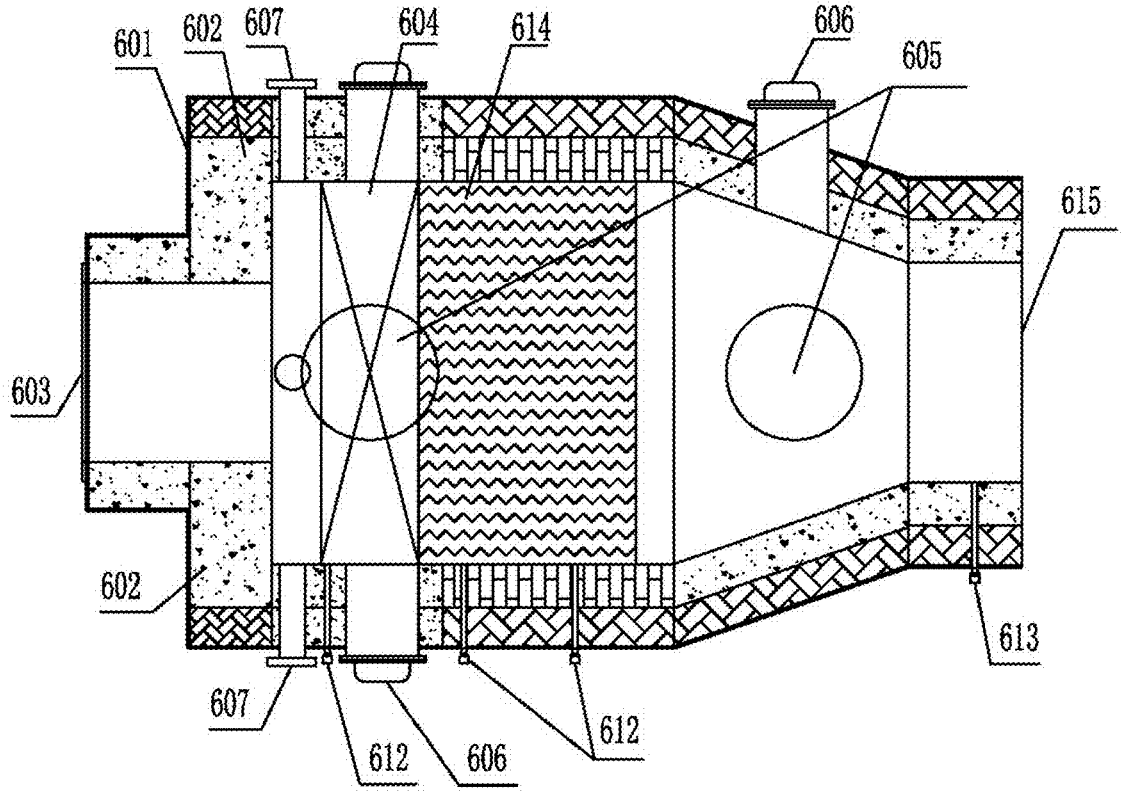
FIG. 9 is a sectional view of the combustion chamber of the present disclosure.
Figure 10:
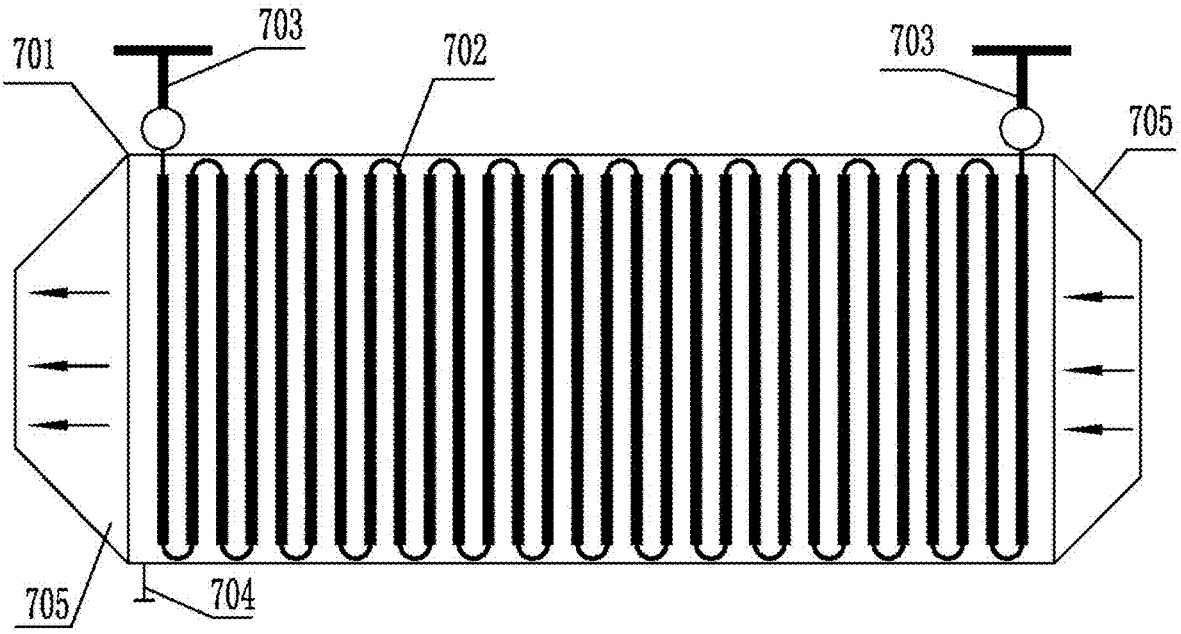
FIG. 10 is a schematic diagram of the structure of a low-temperature flue gas heat extraction device of the present disclosure.

In the drawings: 10, low-concentration gas super-cooling dehydration and demisting device; 101, first temperature detector; 102, demisting and cold energy recovering device; 103, second temperature detector; 104, super-cooling and gravity dehydration device; 105, third temperature detector; 106, first capillary spiral heat exchange tube 107, wire mesh defoaming device; 108, gas-water separation chamber; 109, serpentine finned tube; 110, guide plate; 111, weight dehydration chamber; 20, gas pretreatment device; 201, gas inlet; 202, equipment cylindrical body; 203, intermediate medium outlet; 204, second capillary spiral heat exchange tube; 205, intermediate medium inlet; 206, movable valve; 207, spiral duct; 301, high-temperature resistant outer casing; 302, ventilation air and recirculating flue gas inlet; 303, multi-layer large-aperture galling wire mesh; 304, swirler; 401, high-temperature resistant framework; 402, porous ceramic refractory balls; 403, refractory ball retaining wall; 501, non-streamline long-term burning open fire solid; 502, non-streamline flow guide device; 503, bamboo basket type non-streamline dispersion reverse heating device; 504, continuous high-temperature hot pool; 60, combustion chamber; 601, outer casing; 602, furnace wall; 603, main burner interface; 604, reaction space; 605, explosion-proof opening; 606, manhole; 607, viewing port; 608, auxiliary burner interface; 609, ignition hole; 610, flame detection interface; 611, main flame temperature measurement point; 612, combustion chamber temperature measurement point; 613, combustion chamber outlet flue gas temperature measurement point; 614, labyrinth flue gas channel; 615, outlet for flue gas after reaction; 70, low-temperature flue gas heat extraction device; 701, case; 702, heat exchange element; 703, intermediate medium interface; 704, condensation port; 705, low-temperature flue gas interface; 80, low-concentration gas concentration regulation device.

EMBODIMENTS

The technical solutions in the Examples of the present disclosure will be described clearly and completely in conjunction with the accompanying drawings in the Examples of the present disclosure. Obviously, the described Examples are only a part of the Examples of the present disclosure, rather than all the Examples. Based on the Examples of the present disclosure, all other Examples obtained by those skilled in the art without creative work shall fall within the protection scope of the present disclosure.

As shown in FIG. 1, a low-concentration gas differential combustion device includes: a low-concentration gas super-cooling dehydration and demisting device 10, a gas pretreatment device 20, a burner, a long-term burning open fire device, a high-energy self-heat dispersion rapid ignition device, a combustion chamber 60, and a waste-heat utilization device. The low-concentration gas super-cooling dehydration and demisting device 10 is installed behind a last-stage water-sealing fire-barriering explosion-venting device of a low-concentration gas safe transport system. The low-concentration gas super-cooling dehydration and demisting device 10 is connected to a flameout and backfire protection control device and a low-concentration gas concentration regulation device 80. The low-concentration gas concentration regulation device 80 is connected to the gas pretreatment device 20, the gas pretreatment device 20 is connected to the burner, the burner is connected to the combustion chamber 60, the combustion chamber 60 is connected to the waste-heat utilization device, and both the long-term burning open fire device and the high-energy self-heat dispersion rapid ignition device are connected to the combustion chamber 60.

The backfire and flameout protection control device includes flame detection, a gas source shut-off valve, an air purge solenoid valve, gas source pressure detection, and a control system. The control portion of the backfire and flameout protection control device is connected to the system control cabinet, the gas inlet is connected to the low-concentration gas super-cooling dehydration and demisting device and the outlet is connected to the low-concentration gas concentration regulation device. The flame probe of the flame detector for flameout is installed at the outlet of the burner in the combustion chamber, and the flame detector for backfire is installed on the front-end gas pipeline of the gas pretreatment device. A gas source emergency shut-off valve and an air purge solenoid valve perform protection actions according to the instructions of the control system. The protection actions of the gas source emergency shut-off valve and the air purge solenoid valve includes flameout protection, backfire protection, and gas source low pressure protection.

The low-concentration gas concentration regulation device 80 includes a concentration detector, an automatic control system, a low-concentration gas control valve, a mixing device, a blower, an induced draft fan, a frequency conversion control cabinet, a ventilation air or air control valve, a safety door, and the like. The inlet of the low-concentration gas concentration regulation device 80 is connected to an actuating mechanism of the flameout and backfire protection control device, wherein one end is connected to the ventilation air source, and the outlet is connected to the gas pretreatment device 20. The air or ventilation air interface of the mixer is connected to the ventilation air (or air) pipeline.

The low-concentration gas super-cooling dehydration and demisting device 10 includes a first temperature detector 101, a second temperature detector 103, a third temperature detector 105, a demisting and cold energy recovering device 102, and a super-cooling and gravity dehydration device 104. The heat exchange tube in the demisting and cold energy recovering device 102 is the first capillary spiral heat exchange tube 106. The dehydrated gas flows in the first capillary spiral heat exchange tube 106, and the undehydrated gas flows outside the first capillary spiral heat exchange tube 106. The gas outside the first capillary spiral heat exchange tube 106 enters the equipment from the top portion and flows out from the bottom portion to complete the cold energy recovery and partial gas-water separation. A gas-water separation chamber 108 and a wire mesh defoaming device 107 are further provided in the demisting and cold energy recovering device 102 to further dehydrate the super-cooled gas. The heat exchange tube in the super-cooling and gravity dehydration device 104 is a serpentine tube composed of a bimetallic finned tube. An intermediate medium flows in the serpentine finned tube 409, and the gas flows outside the serpentine finned tube 109. A guide plate 110 and a gravity dehydration chamber 111 are further provided in the super-cooling and gravity dehydration device 104. The gas coming out from the low-concentration gas safe transport system first passes through the demisting and cold energy recovering device 102 to recover the cold energy of the cooled gas. While the temperature of the gas is reduced, the temperature of the dehydrated gas rises accordingly.

The low-concentration gas transported from the coal mine drainage pumping station and the safe transport system will cause difficulty in ignition due to low gas concentration, high water content, and low calorific value. The effective components of gas need to be improved. Among them, the water content seriously affects the stability of ignition, and reducing the water content will increase the success rate of ignition.

Specifically, the low-concentration gas super-cooling dehydration and demisting device 10 is installed at the outlet of the water-sealing fire-barriering explosion-venting device at the end of the low-concentration gas safe transport system to supercool the gas and separate the moisture. The temperature of the gas is forcibly reduced through the super-cooling equipment. In addition to separating the original free liquid water, part of the gaseous water is forcibly liquefied. The liquefied water and the original free liquid water are subject to gas-water separation under the action of gravity and inertia force. A small amount of very small water droplets are demisted by the multilayer staggered wire mesh defoaming device 107, so that the small water droplets are collected into larger water droplets to be captured. The demisted gas is at 100% relative humidity at low-temperature. The cold energy recovery device is installed at the outlet of the demisting device, that is, the cold energy recovery device is installed at the outlet of the wire mesh defoaming device 107. The cooled and dehydrated gas is used to cool the gas from the previous gas source, and at the same time, the cooled and demisted gas is heated. The low-concentration gas after cooling flows in the first capillary spiral heat exchange tube 106, and the low-concentration gas before forced cooling flows outside the first capillary spiral heat exchange tube 106, so that the temperature of the dehydrated gas is raised and part of the cold energy is recovered. As a result, the temperature of the final dehydrated gas is raised and the relative humidity is reduced, the content of effective components is increased, and the conditions for the smooth ignition of the low-concentration gas are created. The dried gas after dehydration flows in the capillary tube. The travel outside the tube is the gas before dehydration, and a large amount of water films will be formed on the outer wall of the tube after its temperature is reduced. Due to the existence of a large amount of water films outside the tube, a potential flameout cooling effect will be formed. When no flame is formed, the flameout cooling effect is in a latent state. When a flame occurs, the latent flameout effect appears immediately to extinguish the flame in time.

The gas pretreatment device 20 includes a gas inlet 201, an equipment cylindrical body 202, a second capillary spiral heat exchange tube 204, a movable valve 206, a spiral duct 207, an intermediate medium inlet 205, and an intermediate medium outlet 203. The gas inlet is connected to the low-concentration gas concentration regulation device 80, and is installed behind the low-concentration gas concentration regulation device 80. The gas flows in the second capillary spiral heat exchange tube 204 of the gas pretreatment device 20, enters the movable valve 206 from the outlet at the other end of the second capillary spiral heat exchange tube 204. The gas opens the movable valve 206 with its own pressure and enters the burner from the outlet of the spiral duct 207, wherein the outlet of the movable valve 206 is connected to the spiral duct 207. The intermediate medium inlet 205 and the intermediate medium outlet 203 are respectively connected to the low-temperature flue gas heat extraction device 70 of the waste-heat utilization device. The intermediate medium circulates between the low-temperature flue gas heat extraction device 70 and the gas pretreatment device 20. The low-temperature low-concentration gas is forcibly heated by the intermediate medium in the second capillary spiral heat exchange tube 204. Compared with the low-concentration gas source, the gas pretreatment device 20 not only plays the role of heating the gas and raising the initial temperature, but also plays the role of forced cooling and extinguishing, and can set up multiple levels of tandem operation according to the actual coal mine gas source. As the concentration of the gas source decreases, the preheating temperature may be raised, and as the concentration of the gas source increases, the preheating temperature may be reduced. When the gas concentration is greater than 4%, the preheating temperature does not exceed 100° C., and when the gas concentration is lower than 4%, the preheating temperature does not exceed 250° C. With respect to the low-concentration gas, a hot wall effect occurs on the inner wall of second capillary spiral heat exchange tube 204 to preheat the gas. And with respect to backfire, a cold wall effect occurs on the inner wall of second capillary spiral heat exchange tube 204 to forcibly extinguish the flame of the backfire. When the hot wall effect occurs, the cold wall effect is latent, and when the cold wall effect occurs, the hot wall effect is latent, and both exist at the same time. The movable valve 206 includes a guide rod, a guide tube, a valve retainer, a valve, and a valve spring. The relationship between pressure and flow rate is adjusted by adjusting the tensioning force of the valve spring. When the valve can be opened, the pressure of the gas source is proportional to the flow rate. The spiral duct 207 is connected to the valve outlet, and the low-concentration gas discharged from the valve enters the burner in a rotating flow mode. The movable valve outlet extends into the burner.

The spiral duct 207 and the movable valve 206 are arranged one-to-one, and the two are seamlessly connected. The outlet of each movable valve 206 is connected to one spiral duct 207, and the outlet of the entire gas pretreatment device 20 is in a tube bundle structure. Ventilation air and recirculating flue gas may be added to an outer side of the spiral duct 207. The outlet of the second capillary spiral heat exchange tube 204 is connected to an internal movable valve 206. The movable valve 206 is automatically opened by the pressure of the gas, and automatically closed when the pressure is low to prevent an occurrence of backfire when the gas amount is too small or the pressure is too low.

The gas inlet of the low-concentration gas pretreatment device 20 is in communication with the low-concentration gas concentration regulation device 80 and is installed behind the low-concentration gas concentration regulation device 80. The outlet is in communication with the burner. The gas pretreatment device 20 is provided with a second capillary spiral heat exchange tube 204 with a fluid having a relatively large heat transfer coefficient on the outside, which is usually in a heating state for gas. The outlet of the second capillary spiral heat exchanger 204 is connected to the internal movable valve 206 mechanism. The movable valve 206 is automatically opened by the pressure of the gas and automatically closed when the pressure is low. The occurrence of backfire when the gas amount is too small or the pressure is too low is prevented. The second capillary spiral heat exchange tube 204 further raises the initial temperature of the gas, which is beneficial to the direct ignition and combustion of the gas. At the same time, when there is no backfire phenomenon, the forced fire distinguishing effect is in a latent state, and the hot wall effect plays a leading role, raising the initial temperature of the gas. When backfire occurs, the cold wall effect of forced fire extinguishing comes into play immediately and naturally.

The gas flows in the second capillary spiral heat exchange tube 204 of the gas pretreatment device 20, and enters the movable valve 206 from the outlet at the other end of the second capillary spiral heat exchange tube 204. The gas opens the movable valve 206 by its own pressure. The outlet of the movable valve 206 is connected to the spiral duct 207. The gas enters the burner from the outlet of the spiral duct 207. The intermediate medium outlet 203 is connected to the inlet of the low-temperature flue gas heat extraction device 70, and the intermediate medium inlet 205 is connected to the outlet of the low-temperature flue gas heat extraction device 70. The intermediate medium transfers the heat of the low-temperature flue gas to the gas, so as to raise the initial temperature of the low-concentration gas. At the same time, the intermediate medium is generally water, which has a heat transfer coefficient several times greater than that of gas, so that the inner wall temperature of the second capillary spiral heat exchange tube 204 is close to the temperature of the intermediate medium, and thereby, the inner wall temperature of the second spiral capillary heat exchange tube 204 can be effectively controlled. The low-concentration gas is in a rotating flow state in the second capillary spiral heat exchange tube 204. When the gas source pressure is too low, if a backfire phenomenon occurs, the flame propagation velocity at this time is greater than the flow velocity of the low-concentration gas. The flame spreading backward is in a reverse rotating flow state in the second capillary spiral heat exchange tube 204, and the flame and reaction chain continuously collide with the tube wall of the second capillary spiral heat exchange tube 204 during the rotating flow process. The tube wall has a forced cooling effect, which interrupts the flame and the reaction chain spreading backward to stop the backfire. When the gas pressure is normal and the flow velocity is greater than the flame propagation velocity, the gas flows normally and is heated by the intermediate medium in the second capillary spiral heat exchange tube 204, so that the initial temperature of the low-concentration gas is raised and the difficulty of ignition is reduced.

The burner is in direct communication with the gas pretreatment device 20. The burner is provided with an input pipeline through which the combustion-supporting medium and the compulsory cooling medium are introduced. The main body is installed on the cylindrical body of the combustion chamber 60, and the outlet thereof is in direct communication with the combustion chamber 60. The burner includes a main burner and an auxiliary burner, both of which are made of high-temperature resistant materials. The main burner includes a high-temperature resistant outer casing 301, a ventilation air and recirculating flue gas inlet 302, a multilayer large-aperture galling wire mesh 303, and a swirler 304. The spiral duct 207 extends into the burner. The multilayer large-aperture galling wire mesh 303 abuts against the swirler 304. The gas enters the swirler 304 from the wire mesh layer of the multilayer large-aperture galling wire mesh 303, and then the gas enters the combustion chamber 60 in a rotating manner. The gas flow velocity in the burner is lower than the flow velocity in the spiral duct 207. A backfire occurs during the internal operation of the burner, but the backfire is only in the burner. Since the burner is relatively short, there will be no rapid increase in combustion pressure and instantaneous blasting when a backfire occurs inside, and there will be no loud noise due to instantaneous blasting. The multilayer large-aperture galling wire mesh 303 is used for secondary distribution and rapid ignition of the ejected gas.

The auxiliary burner does not control the concentration, but directly uses low-concentration gas for buried type combustion, and the outlet thereof is buried under the long-term burning open fire device. The main burner is above the auxiliary burner. The flame is in a buried state at the outlet of the burner. The gas is ejected from the auxiliary burner and then enters the buried layer. The flame penetrates through the gaps of the buried layer. The buried layer dominates the flame direction by designing different porosities, and guides the flame of the auxiliary burner to the outlet of the main burner. The auxiliary burner allows the mixed liquefied gas to remain ignited when the concentration of the low-concentration gas is particularly low. The flame of the long-term burning open fire in the buried layer burned by the auxiliary burner is used for long-term heating and raising the temperature of the combustion chamber. The structure of the main burner is the same as the structure of the auxiliary burner. The ventilation air and recirculating flue gas inlet 302 of the auxiliary burner is only connected to the ventilation air, and the ventilation air and recirculating flue gas inlet 302 of the main burner may also be connected to the recirculating flue gas to control the stability of the overall temperature of the combustion chamber 60 when the gas concentration is relatively high.

The low-concentration gas pipeline is provided with a first flame detector, and the first flame detector is connected to an automatic control system. According to the flame signal detected by the first flame detector, the automatic control system can cut off the gas source, perform backfire protection, and perform pre-purge to prevent the flame from spreading in the pipeline. The outlet of the burner is provided with a second flame detector. The control system can judge the flame extinguishing situation of the outlet of the burner 60 in time according to the flame signal of the second flame detector, and perform the flameout protection control in time, and at the same time purge the pipeline at the back end of the protection system.

The burner accepts the condition of being heated by the backfire when the gas flow rate is zero, and the burner is in a direct communication with the combustion chamber 60 in a straight line, allowing backfire to occur inside the burner when the gas is zero. When a backfire occurs, there is no high static pressure and instantaneous pressure release process inside the burner. A high-temperature radiation is accepted after the fire is extinguished, and an air or gas cooling condition is accepted when gas enters during the start-up process, and the low-concentration gas is allowed to be ignited inside.

The staggered high-temperature resistant multilayer large-aperture galling wire mesh 303 of the burner is different from the metal fiber provided in the conventional surface burner. This wire mesh has a large-aperture structure, and its purpose is not to prevent backfire, but to perform secondary distribution and rapid ignition of the gas ejected from the nozzle. The gas is allowed to burn between the wire mesh and the nozzle. Ignition and combustion in the burner is allowed, and the pressure of the gas combustion inside the burner can be released in time and the occurrence of ignition explosion can be prevented. The burner is different from the conventional burner in that it allows flame lifting and a backfire inside the main body, and is suitable for ultra-high-speed ejecting combustion.

The long-term burning open fire device includes an original low-concentration gas ejection gun and a radiation ignition device, which are installed at the bottom of the burner interface of the combustion chamber; and further includes a high-temperature resistant framework 401, porous ceramic refractory balls 402, and a refractory ball retaining wall 403. The high-temperature resistant framework 401 supports the porous ceramic refractory balls 402 at the outlet of the auxiliary burner, so that an ejection space is reserved at the outlet of the auxiliary burner. The refractory ball retaining wall 403 for the porous ceramic refractory balls 402 is arranged directly in front of the outlet of the auxiliary burner. A gap for filling refractory balls is reserved between the refractory ball retaining wall 403 and the high-temperature resistant framework 401, which is used to fill the porous ceramic refractory balls 402. The guiding direction of the flame is determined by the stacking position of the porous ceramic refractory balls 402 of different sizes. The porous ceramic refractory balls 402 are located in the buried layer of buried type combustion. The flame is ejected from gaps of the porous ceramic refractory balls 402. It is designed to direct the mainstream flame of the long-term burning open fire and the mainstream flue gas to the outlet of the main burner, so that the flame of the long-term burning open fire and the high-temperature flue gas produced by the long-term burning open fire device flow through the outlet of the auxiliary burner to the outlet of the main burner to actively ignite the outlet gas of the main burner. The long-term burning open fire device has a relatively high heat storage capacity, and even when the gas source of the auxiliary burner is cut off in a short period of time, the long-term burning open fire device still has a strong ignition capacity.

After the ignition is succeeded, the porous ceramic refractory balls 402 are heated by the combustion flame to 1200° C. or higher, even higher than 1600° C. It has considerable heat storage capacity and capacity of heating and igniting gas. The gas can still be ignited in time and burned stably even when it fluctuates, and the combustion flame and the high-temperature flue gas can be guided to the direction of the outlet of the main burner.

The long-term burning open fire device uses low-concentration gas with a relatively high concentration and an auxiliary burner with a relatively small diameter to maintain a long-term burning open fire state in the furnace. The long-term burning open fire device has a local ultra-high temperature structure, and in principle, no compulsory temperature control means is provided. Its flame form is a multi-beam flame form rather than a single flame form, and the center of the fire source is a very small semi-sealed confined space with a deceleration effect. The confined space is formed by burying and stacking porous ceramic refractory balls 402 with certain air permeabilities and refractory bricks with specific shapes. No forced cooling control means is provided, and the local flame temperature is allowed to exceed 1600° C. for a long period of time. The air permeability in the transverse direction and the air permeability in the longitudinal direction are different. The different permeabilities are used to guide the direction of the long-term burning open fire, so that the flame of the long-term burning open fire and the high-temperature products flow toward the direction of the outlet main burner. The auxiliary burner allows mixed liquefied gas to remain ignition when the concentration of the low-concentration gas is particularly low.

The high-energy self-heat dispersion rapid ignition device includes a non-streamline long-term burning open fire solid 501, a non-streamline flow guide device 502, a bamboo basket type non-streamline dispersion reverse heating device 503, and a continuous high-temperature hot pool 504 installed in the vicinity of the burner. The high-energy self-heat dispersion rapid ignition device is installed at the front end inside the combustion chamber 60 and is close to the burner. The inlet of the high-energy self-heat dispersion rapid ignition device is directly opposite to the burner, and the outlet is dispersed to the front and the rear directions of the entire combustion chamber 60. The high-temperature heat energy generated by the first burned gas is reserved near the burner, and radiation, conduction, convection, and mixed heating methods are used to quickly heat and ignite the low-concentration gas at the outlet of the burner in time.

The non-streamline long-term burning open fire solid 501 is a non-streamline high-temperature solid heat storage material heated after the low-concentration gas combustion, has a surface presenting an uneven shape and a porous structure, during normal operation, uses heat of the low-concentration gas combustion to raise its own temperature to 900-1100° C., and has a high-temperature ignition function.

The non-streamline flow guide device 502 is made of refractory material having a conical contour with an uneven surface and a partially non-streamlined spiral structure, and is installed facing the main burner. The low-concentration gas ejected from the main burner is first guided and dispersed by the non-streamline flow guide device 502.

The bamboo basket type non-streamline dispersion reverse heating device 503 has a porous structure, which allows a small amount of gas to be heated and pass through the gap, and at the same time reversely guides the flow of most of the low-concentration gas and the high-temperature flue gas formed after complete combustion, and quickly mixes and ignites the reversely guided flow of the high-temperature flue gas and the newly entered low-concentration gas.

The continuous high-temperature hot pool 504 is a high-temperature hot pool formed by a porous refractory material combined with a reverse air flow space, and constitutes reliable conditions for comprehensive heating, reverse ignition and stable combustion. At the same time, a high-temperature heat storage body composed of porous refractory materials is integrally assembled with the non-streamline flow guide device 502 and the non-streamline long-term burning open fire solid 501 to form a complete combination.

Different from other fuel gas equipment, after the gas is ejected from the nozzle of the burner, the gas is first dispersed by the non-streamline flow guide device 502, and then is ignited by the high-temperature flue gas dispersed by the long-term burning open fire device, the non-streamline long-term burning open fire solid 501, and the bamboo basket type non-streamline dispersion reverse heating device 503. The non-streamline flow guide device 502 reversely disperses and guides part of the combustion products and part of the low-concentration gas, so that the mainstream high-temperature flue gas and the flame are dispersed and returned to the space around the main burner, and redistributed to flow backwards in the longitudinally and transversely staggered flow channels, and gradually replace the combustion products and heat in the flow channels, push the previous combustion heat and high-temperature flue gas back at any time, and keep the burning heat and high-temperature flue gas in the flow channels. The secondary gas and combustion products pass through the non-linear gaps of the bamboo basket type non-streamline dispersion heating device 503, enter the continuous high-temperature hot pool 504, and gradually replace the heat and high-temperature flue gas generated before combustion through the flow of the flue gas to push the previous combustion heat and the high-temperature flue gas out of the continuous high-temperature hot pool 504, and temporarily reserve the burning heat and the high-temperature flue gas in the continuous high-temperature hot pool 504.

The high-energy self-heat dispersion rapid ignition device uses the combustion heat of the low-concentration gas that has been ignited. The ignition energy thereof is an exponential multiple of the minimum ignition energy. Even if the gas concentration is reduced to the point where it cannot maintain its own reactive temperature in a short period of time, the high-temperature flue gas and the return flame can be used to completely burn the entered low-concentration gas. In order to prevent the flame from extinguishing, even when the gas concentration continuously decreases to a lower level in a short period of time, the continuous high-temperature hot pool 504 can still heat and ignite the newly entered low-concentration gas in an instant to prevent the flame from extinguishing.

The high-energy self-heat dispersion rapid ignition device also has a flame interception function. When the low-concentration gas is ejected from the burner too fast or even much faster than the flame propagation velocity, this device can intercept back the escaped flame and make the flame away from the burner close to the burner. Even when the nozzle flow velocity of the burner reaches 100 m/s, a flameout phenomenon due to flame lifting will not occur.

According to the conventional burner arrangement, the nozzle flow velocity of the burner must be controlled to be slightly greater than the flame propagation velocity to prevent flame lifting and backfire. The combined action of the high-energy self-heat dispersion rapid ignition device is as follows. The nozzle flow velocity of the burner is much greater than the flame propagation velocity during normal combustion, and at this time, the flame escaping from the burner can be effectively intercepted and made close to the burner, and the combined action of the intercepted flame, the returned high-temperature flue gas, the non-streamline long-term burning open fire solid 501 and the continuous high-temperature hot pool 504 is used to ignite the newly entered gas in time. The low-concentration gas ejected from the burner is ignited at the moment when it flows out of the nozzle of the burner, and the ignition delay of the gas entering the combustion chamber 60 is prevented. Since there is no accumulation of gas in the combustion chamber 60, the gas is in a state of flowing combustion. Although the combustion reaction speed is fast, the pressure generated by the combustion is not high. It is almost in a constant pressure combustion process, eliminating the first stage of the ignition explosion, which is rapid increase in pressure. At the same time, there is no instantaneous release process of high pressure, which solves the problem of ignition explosion of low-concentration gas.

The low-concentration gas is a mixed gas of methane and air, and the equivalent ratio after mixing is usually ≤1:2. The low-concentration gas is prone to explosion and a backfire after encountering an open fire. The conventional ignition and combustion mode is to stabilize the combustion by controlling the nozzle flow velocity of the burner to be slightly larger than the flame propagation velocity. The low-concentration gas in coal mines is currently not allowed to be stored and buffered, and its flow rate, pressure, concentration and other parameters may change at any time. Therefore, the actual coal mine gas is prone to backfire, flame lifting or even flameout using conventional design schemes and cannot complete safe and stable combustion.

The combustion chamber 60 includes an outer casing 601, a furnace wall 602, a main burner interface 603, a reaction space 604, explosion-proof openings 605, manholes 606, viewing ports 607, an auxiliary burner interface 608, an ignition hole 609, a flame detection interface 610, a main flame temperature measurement point 611, a combustion chamber temperature measurement point 612, a combustion chamber outlet flue gas temperature measurement point 613, a labyrinth flue gas channel 614, and an outlet for flue gas after reaction 615. The main burner interface 603 is installed in the center of the front wall directly in front of the combustion chamber 60 to avoid the high-temperature flue gas flow deflection and local overheating. The reaction space 604 provides an installation space for the high-energy self-heat dispersion rapid ignition device and a reaction space for complete combustion of the low-concentration gas. The explosion-proof openings 605 are arranged on the front part of the side wall and the side wall or top portion behind the labyrinth flue gas channel 614 to prevent damage caused by detonation overpressure. The manholes 606 are installed on the side wall behind the explosion-proof openings 605, with a built-in refractory lining and thermal insulation material. The viewing ports 607 are installed on the side wall, facing the positions of the main flame and the long-term burning open fire to facilitate observation. The auxiliary burner interface 608 is installed directly below the main burner interface 603 to provide heat for the ignition temperature rising and the long-term burning open fire. The ignition hole 609 is located directly below the auxiliary burner interface 608 and close to the auxiliary burner interface 608 to facilitate ignition. The flame detection interface 610 is close to the ignition hole 609 and the auxiliary burner interface 608, so that it is convenient to install a flame detector to detect the long-term burning open fire and the flame of ignition. The main flame temperature measurement point 611 is installed at a position close to the main burner interface 603 to facilitate the detection of the temperature of the main flame. The combustion chamber temperature measurement point 612 is installed on the side wall of the combustion chamber 60, and probe of the temperature measurement point is extended to the vicinity of the central axis of the combustion chamber 60. The combustion chamber outlet flue gas temperature measurement point 613 is installed behind the reducer pipe at the outlet of the combustion chamber 60, and the temperature measurement point is extended into the axial position of flue pipe interface. The labyrinth flue gas channel 614 is installed behind the reaction space 604 inside the combustion chamber 60 to facilitate the flow of the combustion products in crisscrossed trajectories, prolong the flow path of the flue gas, increase the reaction time, prevent the gas escaping and increase the oxidation rate. The outlet for flue gas after reaction 615 is the final outlet of the combustion chamber 60, through which all the combustion products and high-temperature heat are discharged.

The combustion chamber further includes a refractory material, a thermal insulation material, a labyrinth heat storage flow path, a reverse flow device, and a mixing heating device. A closed reaction space above the reactive temperature can be formed inside the combustion chamber, which provides sufficient residence time for the complete combustion of the low-concentration gas, and guides the combustion products and high-temperature heat to the flue gas outlet. The high-energy natural dispersion rapid ignition device is installed at the front end inside the combustion chamber 60 to provide installation space for the high-energy self-heat dispersion rapid ignition device and temporarily store the heat and high-temperature flue gas generated by combustion inside, and guide the high-temperature flue gas to flow to the outlet to provide heat for the subsequent waste-heat utilization device. The combustion chamber 60 provides a high-temperature closed environment for combustion, so that the ignited low-concentration gas is fully reacted here.

The waste-heat utilization device includes a low-temperature flue gas heat extraction device 70, a feedwater heater, an evaporator, a steam superheater, and a water cooling panel. The low-temperature flue gas heat extraction device 70 includes a case 701, a heat exchange element 702, an intermediate medium interface 703, a condensation port 704, and a low-temperature flue gas interface 705. The case 701 is the outer casing of the low-temperature flue gas heat extraction device 70, and is provided with a heat exchange element 702 inside. The heat exchange element 702 is connected to the intermediate medium header. The heat exchange element 702 collects outflow and inflow through the intermediate medium header. The intermediate medium interface is installed on the intermediate medium header. The condensation port 704 is installed at the bottom portion of the outer casing near the outlet for low-temperature flue gas to discharge the condensed water of the low-temperature flue gas. The low-temperature flue gas interface 705 includes an inlet and an outlet for low-temperature flue gas. The intermediate medium interface 703 is connected to the intermediate medium interface of the gas pretreatment device 20 through a pipeline, and the low-temperature flue gas interface 705 is in communication with the flue pipe.

In the low-temperature flue gas heat extraction device 70, in the case of the gas source concentration ≥4%, the initial temperature of the preheated gas does not exceed 100° C., and the temperature of the intermediate medium is not higher than 150° C. In the case of the gas source concentration <4%, the initial temperature of the preheated gas does not exceed 250° C., and the temperature of the intermediate medium is not higher than 300° C.

The difference between the exhaust smoke temperature and the initial gas temperature is ≤60° C. The mixed concentration of the low-concentration gas entering the combustion system is always accurately controlled at 8% or less. The gas source concentration is 3-8% without requirement of precise adjustment, and it is corrected with the oxygen content of the tail flue gas. Fire extinguishing and explosion prevention are realized by the cold wall effect and gas preheating is realized by the hot wall effect. The cold wall effect and the hot wall effect exist at the same time. In the state of no backfire, the cold wall effect is latent, and the hot wall effect plays a role. When a backfire occurs, the hot wall effect is latent and the cold wall effect plays a role. The low flow velocity of the movable valve is automatically closed to prevent backfire. A backfire is allowed in the burner. The buried type combustion forms a stable long-term burning open fire. The high-energy self-heat dispersion rapid ignition device plays the roles of flow guide dispersion ignition, long-term burning open fire solid, reverse backfire, restricted fire leakage, forced return of flue gas and the like, to realize safe and stable combustion of the low-concentration gas, prevent the explosion during the combustion process of the low-concentration gas and return the flame back to the low-concentration gas safe transport system.

The low-concentration gas differential combustion device further includes a tail low-temperature flue gas waste-heat utilization device. The tail low-temperature flue gas waste-heat utilization device includes a heat energy transfer device of the tail low-temperature waste heat, an intermediate circulating medium, a circulating pump of the circulating medium, and a circulating medium pipeline. The circulating medium absorbs the heat of the tail low-temperature flue gas inside the heat exchange tube to raise its own temperature, and the intermediate medium circulates between the tail low-temperature waste-heat utilization device and the pretreatment device.

The feedwater heater includes an outer casing, a finned tube, a feedwater interface, and a flue gas interface. The feedwater interface is connected to the feedwater, and the flue gas interface is connected to the flue pipe. The evaporator includes a heat exchange tube, an ascending tube, a descending tube, a header, and a steam drum. The steam drum of the evaporator performs natural convection circulation with the header through the heat exchange tube, the ascending tube, and the descending tube. One end of the ascending tube is in communication with the steam drum of the evaporator, and the other end is in communication with the header on the top of the heat exchange tube. One end of the descending tube is in communication with the bottom portion of the steam drum of the evaporator, and the other end is in communication with the header at the bottom portion of the heat exchange tube. The steam drum of the evaporator is in communication with the water replenishing pipe at the outlet of the feedwater heater. The steam inlet of the steam superheater is in communication with the steam drum of the evaporator, and the steam outlet is in communication with the outgoing steam pipeline. A desuperheater is arranged in the middle of the steam superheater, and the final outlet steam temperature is adjusted by the distribution amount of feedwater.

The low-temperature flue gas heat extraction device 70 is used to recover the waste heat of the tail low-temperature flue gas, and transfer the heat to the gas at the inlet through the intermediate medium with the highest heat transfer coefficient. The intermediate medium circulates between the two repeatedly. The heat extraction tube of the feedwater heater is installed in the flue pipe, and the inlet of the feedwater side is connected to the outlet of the feedwater pump, and the outlet is connected to the steam drum of the evaporator. The steam drum of the evaporator performs natural convection circulation through the heat exchange tube, the ascending tube and the descending tube. One end of the ascending tube is in communication with the steam drum of the evaporator, the other end is in communication with the header at the top portion of the heat exchange tube. One end of the descending tube is in communication with the bottom portion of the steam drum of the evaporator, and the other end is in communication with the header at the bottom portion. The steam drum of the evaporator is in communication with the outlet pipe of the feedwater heater and the steam superheater. One end of the steam superheater on the steam side is in communication with the steam drum of the evaporator, the other end is in communication with the outgoing steam pipeline, and a desuperheater is arranged in the middle. The water cooling panel is installed near the outlet of the combustion chamber to appropriately reduce the temperature of the high-temperature flue gas, so as to protect the steam superheater. The low-concentration gas concentration regulation device 80 further includes a first gas concentration detector and a second gas concentration detector installed on the intake-tube. According to the concentrations of the first and second gas concentration detectors and the oxygen content of the tail flue gas, the control system can adjust the transmission amount of the ventilation air (or air) in the input pipeline to accurately control the concentration and equivalent ratio after mixing.

Although the present disclosure has been described in detail with reference to the above Examples, for those skilled in the art, they can still modify the technical solutions described in the above Examples, or equivalently replace some of the technical features. Any modification, equivalent replacement, improvement, etc. made within the spirit and principle of the present disclosure should be included in the protection scope of the present disclosure.

What is claimed is:

1. A low-concentration gas differential combustion device, comprising:

a low-concentration gas super-cooling dehydration and demisting device, a gas pretreatment device, a burner, a long-term burning open fire device, a high-energy self-heat dispersion rapid ignition device, a combustion chamber, and a waste-heat utilization device, the low-concentration gas super-cooling dehydration and demisting device is installed behind a last-stage water-sealing fire-barriering explosion-venting device of a low-concentration gas safe transport system, the low-concentration gas super-cooling dehydration and demisting device is connected to a flameout and back-fire protection control device and a low-concentration gas concentration regulation device, the low-concentration gas concentration regulation device is connected to the gas pretreatment device, the gas pretreatment device is connected to the burner, the burner is connected to the combustion chamber, the combustion chamber is connected to the waste-heat utilization device, and both the long-term burning open fire device and the high-energy self-heat dispersion rapid ignition device are connected to the combustion chamber; and wherein the gas pretreatment device comprises a gas inlet, a second capillary spiral heat exchange tube, a movable valve, a spiral duct, an intermediate medium inlet, and an intermediate medium outlet, the gas inlet is connected to the low-concentration gas concentration regulation device and installed behind the low-concentration gas concentration regulation device; the gas flows in the second capillary spiral heat exchange tube of the pretreatment device, enters the movable valve from an outlet at the other end of the second capillary spiral heat exchange tube, the gas opens the movable valve with its own pressure and enters the burner from an outlet of the spiral duct to which an outlet of the movable valve is connected; the intermediate medium inlet and the intermediate medium outlet are respectively connected to a low-temperature flue gas heat extraction device of the waste-heat utilization device, and an intermediate medium circulates between the low-temperature flue gas heat extraction device and the gas pretreatment device;

the spiral duct and the movable valve are arranged one-to-one, and the two are seamlessly connected, the outlet of each movable valve is connected to one spiral duct, an outlet of the entire gas pretreatment device is in a tube bundle structure, ventilation air and recirculating flue gas may be added to an outer side of the spiral duct; an outlet of the second capillary spiral heat exchange tube is connected to an internal movable valve, and the movable valve is automatically opened by the pressure of the gas, and automatically closed when the pressure is low to prevent an occurrence of a backfire phenomenon when the gas amount is too small or the pressure is too low.

2. The low-concentration gas differential combustion device according to claim 1, wherein, the low-concentration gas super-cooling dehydration and demisting device comprises a demisting and cold energy recovering device and a super-cooling and gravity dehydration device, a heat exchange tube in the demisting and cold energy recovering device is a first capillary spiral heat exchange tube, dehydrated gas flows in the first capillary spiral heat exchange tube, and undehydrated gas flows outside the first capillary spiral heat exchange tube;

the gas outside the first capillary spiral heat exchange tube enters the device from a top portion and flows out from a bottom portion to complete cold energy recovery and partial gas-water separation, a gas-water separation chamber and a wire mesh defoaming device are further provided in the demisting and cold energy recovering device to further dehydrate the supercooled gas; a heat exchange tube in the super-cooling and gravity dehydration device is a serpentine tube composed of a bimetallic finned tube, an intermediate medium flows in the serpentine finned tube, and gas flows outside the serpentine finned tube; a guide plate and a gravity dehydration chamber are further provided in the supercooling and gravity dehydration device.

3. The low-concentration gas differential combustion device according to claim 1, wherein, the burner is in direct communication with the pretreatment device, the burner is provided with an input pipeline through which a combustion-supporting medium and a compulsory cooling medium are introduced, a main body is installed on a cylindrical body of the combustion chamber, and an outlet thereof is in direct communication with the combustion chamber; the burner comprises a main burner and an auxiliary burner, the main burner comprises a high-temperature resistant outer casing, a ventilation air and recirculating flue gas inlet, a multilayer large-aperture galling wire mesh, and a swirler, the spiral duct extends into the burner, the multilayer large-aperture galling wire mesh abuts against the swirler, the gas enters the swirler from a wire mesh layer of the multilayer large-aperture galling wire mesh, and the gas enters the combustion chamber in a rotating manner; a gas flow velocity in the burner is lower than a flow velocity in the spiral duct, and a backfire is allowed inside the burner, since the burner is relatively short, there will be no rapid increase in combustion pressure and instantaneous blasting when a backfire occurs inside, and there will be no loud noise due to instantaneous blasting; the multilayer large-aperture galling wire mesh is used for secondary distribution and rapid ignition of ejected gas;

the auxiliary burner does not control the concentration, but directly uses low-concentration gas for buried type combustion, an outlet thereof is buried under the long-term burning open fire device, the main burner is above the auxiliary burner, the gas is ejected from the auxiliary burner and then enters a buried layer, flame penetrates through gaps of the buried layer, the buried layer utilizes different porosities to dominate a flame direction, and guides the flame of the auxiliary burner to the outlet of the main burner, the auxiliary burner allows mixed liquefied gas to remain ignited when the low-concentration gas concentration is particularly low; a flame of long-term burning open fire of the buried layer burned by the auxiliary burner is used for long-term heating and raising temperature of the combustion chamber, a structure of the main burner is the same as a structure of the auxiliary burner, the ventilation air and recirculating flue gas inlet of the auxiliary burner is only connected to the ventilation air, the ventilation air and recirculating flue gas inlet of the main burner may also be connected to the recirculating flue gas to control the stability of the overall temperature of the combustion chamber when the gas concentration is relatively high.

4. The low-concentration gas differential combustion device according to claim 3, wherein, the long-term burning open fire device comprises a high-temperature resistant framework, porous ceramic refractory balls, and a refractory ball retaining wall, the high-temperature resistant framework supports the porous ceramic refractory balls at the outlet of the auxiliary burner, so that the outlet of the auxiliary burner retains an ejection space, the refractory ball retaining wall for the porous ceramic refractory balls is arranged directly in front of the outlet of the auxiliary burner, a gap for filling refractory balls is reserved between the refractory ball retaining wall and the high-temperature resistant framework, which is used to fill the porous ceramic refractory balls, and a guiding direction of the flame is determined by a stacking position of the porous ceramic refractory balls of different sizes; the porous ceramic refractory balls are located in the buried layer of buried type combustion, and the flame is ejected from gaps of the porous ceramic refractory balls; the flame of the long-term burning open fire and high-temperature flue gas produced by the long-term burning open fire device flow through the outlet of the auxiliary burner to the outlet of the main burner to actively ignite the outlet gas of the main burner; the long-term burning open fire device has a relatively high heat storage capacity, and even when the gas source of the auxiliary burner is cut off in a short period of time, the long-term burning open fire device still has a strong ignition capacity;

the long-term burning open fire device uses low-concentration gas with a relatively high concentration and an auxiliary burner with a relatively small diameter to maintain a long-term burning open fire state in a furnace; the long-term burning open fire device has a local ultra-high temperature structure, and the flame form thereof is a multi-beam flame form, a center of the fire source is a very small semi-sealed confined space with a deceleration effect, the confined space is formed by burying and stacking porous ceramic refractory balls with certain air permeabilities and refractory bricks with specific shapes, a local flame temperature is allowed to exceed 1600° C. for a long period of time, air permeabilities are different, and the different air permeabilities in a transverse direction and a longitudinal direction are used to guide the direction of the long-term burning open fire, so that the flame of the long-term burning open fire and high-temperature products flow toward the outlet of the main burner outlet.

5. The low-concentration gas differential combustion device according to claim 4, wherein the high-energy self-heat dispersion rapid ignition device comprises a non-streamline long-term burning open fire solid, a non-streamline flow guide device, a bamboo basket type non-streamline dispersion reverse heating device, and a continuous high-temperature hot pool installed in the vicinity of the burner;

the non-streamline long-term burning open fire solid is a non-streamline high-temperature solid heat storage material heated after the low-concentration gas combustion, has a surface presenting an uneven shape and a porous structure, during normal operation, uses heat of the low-concentration gas combustion to raise its own temperature to 900-1100° C., and has a high-temperature ignition function;

the non-streamline flow guide device is made of refractory material having a conical contour with an uneven surface and a partially non-streamlined spiral structure, and is installed facing the main burner, the low-concentration gas ejected from the main burner is first guided and dispersed by the non-streamline flow guide device;

the bamboo basket type non-streamline dispersion reverse heating device has a porous structure, which allows a small amount of gas to be heated and pass through gaps, and at the same time reversely guides a flow of most of the low-concentration gas and the high-temperature flue gas formed after complete combustion, and quickly mixes and ignites the reversely guided flow of high-temperature flue gas and the newly entered low-concentration gas;

the continuous high-temperature hot pool is a high-temperature hot pool formed by a porous refractory material combined with a reverse air flow space, and constitutes reliable conditions for comprehensive heating, reverse ignition and stable combustion, at the same time, a high-temperature heat storage body composed of porous refractory materials is integrally assembled with the non-streamline flow guide device and the non-streamline long-term burning open fire solid to form a complete combination.

6. The low-concentration gas differential combustion device according to claim 1, wherein the combustion chamber provides installation space for the high-energy self-heat dispersion rapid ignition device and temporarily stores the heat and high-temperature flue gas generated by combustion inside, and guides the high-temperature flue gas to flow to the outlet to provide heat for the subsequent waste-heat utilization device, the combustion chamber provides a high-temperature closed environment for combustion, so that the ignited low-concentration gas is fully reacted here.

7. The low-concentration gas differential combustion device according to claim 1, wherein the waste-heat utilization device comprises a low-temperature flue gas heat extraction device, and the low-temperature flue gas heat extraction device includes a case, a heat exchange element, an intermediate medium interface, a condensation port, and a low-temperature flue gas interface, the case is an outer casing of the low-temperature flue gas heat extraction device, and is provided with a heat exchange element inside, the heat exchange element is connected to the intermediate medium header, and the heat exchange element collects outflow and inflow through the intermediate medium header, the intermediate medium interface is installed on the intermediate medium header, the condensation port is installed at a bottom portion of the outer casing near an outlet for low-temperature flue gas to discharge condensed water of the low-temperature flue gas, and the low-temperature flue gas interface comprises an inlet and an outlet for low-temperature flue gas.

8. A low-concentration gas differential combustion method, comprising:

step 1: a gas source enters a low-concentration gas super-cooling dehydration and demisting device through a low-concentration gas safe transport system, the low-concentration gas super-cooling dehydration and demisting device performs forced super-cooling and heat exchange with respect to the gas source, and uses inertia, gravity and demisting means to remove liquid water and part of gaseous condensed water and reduce water content, after the water content is reduced, a cold energy recovery device is used to heat up the supercooled gas and recover part of cold energy, a temperature of dehydrated gas is close to a temperature of the gas source, which reduces ineffective components and increases effective components of the low-concentration gas involved in the combustion, and improves an overall activity;

step 2: the gas passes through the low-concentration gas super-cooling dehydration and demisting device and enters a gas pretreatment device through a low-concentration gas concentration regulation device, the gas pretreatment device not only heats the gas and raises an initial temperature but also plays a role of forced cooling and fire extinguishing; a preheating temperature can be determined according to a concentration of the gas source, that is, the preheating temperature is increased as the concentration of the gas source decreases, and the preheating temperature is reduced as the concentration of the gas source concentration increases;

step 3: after passing through the gas pretreatment device, the gas enters a burner in a rotating manner, the burner is a straight-through burner, and ignition and combustion is allowed inside the burner, so that the low-concentration gas forms two-way differential units in a longitudinal direction and a transverse direction during continuous flow, the gas in each differential unit is gradually pushed forward by the gas flowing behind to form a continuous combustion differential end surface, expansion pressure formed by combustion of the gas inside can be released in time when the gas of each differential unit is combusted, so that sharp rise in pressure of the gas combustion and occurrence of ignition explosion can be prevented;

step 4: the gas passes through the burner and enters a combustion chamber, first, it is guided and dispersed by a high-energy self-heat dispersion rapid ignition device, and then flame and high-temperature flue gas of a long-term burning open fire are directed to an outlet of a main burner of the burner though a long-term burning open fire device and an auxiliary burner of the burner to actively ignite the outlet gas of the main burner, the long-term burning open fire device has a relatively high capacity for storing heat, and even when the gas source of the auxiliary burner gas source is cut off in a short period of time, the long-term burning open fire device can still play an ignition role; the high-energy self-heat dispersion rapid ignition device uses combustion heat of the ignited gas, and even when the gas concentration decreases and is insufficient to maintain its own reactive temperature in a short period of time, it can use the high-temperature flue gas and return flame to ignite and completely burn the entered gas of each differential unit in time to prevent the flame from extinguishing, even when the gas concentration continues to decrease to a lower level in a short period of time, a continuous high-temperature hot pool thereof can still heat and ignite the newly entered gas in an instant to prevent the flame from extinguishing;

step 5: after the gas is fully combusted in the combustion chamber, heat and high-temperature flue gas generated by combustion are guided to a waste-heat utilization device, especially the low-temperature flue gas waste heat at a tail portion is used to heat dehydrated low-concentration gas through an intermediate medium, thereby reducing loss of exhaust smoke, and at the same time raising an initial temperature of the low-concentration gas, and improving an efficiency of the entire combustion system.

* * * * *